United States Patent [19]

Way

[11] Patent Number: 4,910,930

[45] Date of Patent: Mar. 27, 1990

[54] SEISMIC ISOLATION STRUCTURE

[75] Inventor: Douglas Way, Sausalito, Calif.

[73] Assignee: Base Isolation Consultants, Inc., San Francisco, Calif.

[21] Appl. No.: 264,099

[22] Filed: Oct. 28, 1988

[51] Int. Cl.[4] ..... E04H 9/02

[52] U.S. Cl. ..... 52/167 R

[58] Field of Search ..... 52/167

[56] References Cited

U.S. PATENT DOCUMENTS

| | | | |
|---|---|---|---|
| 3,212,745 | 10/1965 | Lode | 52/167 X |
| 3,906,689 | 9/1975 | Nakayama | 52/167 |
| 4,121,393 | 10/1978 | Renault et al. | 52/167 |
| 4,527,365 | 7/1985 | Yoshizawa et al. | 52/167 |
| 4,565,039 | 1/1986 | Orguro et al. | 52/167 |
| 4,599,834 | 7/1986 | Fujimoto et al. | 52/167 |
| 4,713,917 | 12/1987 | Buckle et al. | 52/167 |

FOREIGN PATENT DOCUMENTS

| | | | |
|---|---|---|---|
| 1289078 | 2/1969 | Fed. Rep. of Germany | 52/167 |
| 2628276 | 7/1975 | Fed. Rep. of Germany | 52/167 |
| 7532989 | 6/1977 | France | 52/167 |
| 0134230 | 8/1984 | Japan | 52/167 |

*Primary Examiner*—David A. Scherbel
*Assistant Examiner*—Anthony W. Williams
*Attorney, Agent, or Firm*—Flehr, Hohbach, Test, Albritton & Herbert

[57] ABSTRACT

A seismic isolation structure for use in conjunction with a foundation of a building which has a plurality of footings and a building which has a plurality of columns. At least one high damping elastomeric bearing is mounted on the footing and supports the column. At least one ultimate restraint device is connected between the footing and the support column. The ultimate restraint device is spaced apart and separate from the bearing.

5 Claims, 2 Drawing Sheets

F=H-OVERTURNING MOMENT
R=E-RESISTING MOMENT

SEISMIC ISOLATION STRUCTURE

This invention relates to a seismic isolation structure and more particularly to a seismic isolation for use on buildings.

In the past seismic isolation structures have been provided for buildings and the like for reducing the effects of earthquakes on buildings. Such seismic isolation structures have been utilized to uncouple the building from the horizontal components of the earthquake ground motion and simultaneously to support the vertical weight of the building. Such seismic isolation structures have been unduly complicated and in addition, they have often failed to provide means for unlimiting the ultimate displacement of the building in the event of an earthquake. There is therefore a need for a new and improved seismic isolation structure.

In general, it is an object of the present invention to provide a seismic isolation structure which is fail-safe.

Another object of the invention is to provide a seismic isolation structure which includes an ultimate restraint device.

Another object of the invention is to provide a seismic isolation structure which is provided with uplift control.

Another object of the invention is to provide a structure of the above character which utilizes high damping elastomeric bearings with ultimate restraint devices spaced from the high damping elastomeric bearings.

Additional objects and features of the invention will appear from the following description in which the preferred embodiments are set forth in detail in conjunction with the accompanying drawings.

Figure 1:
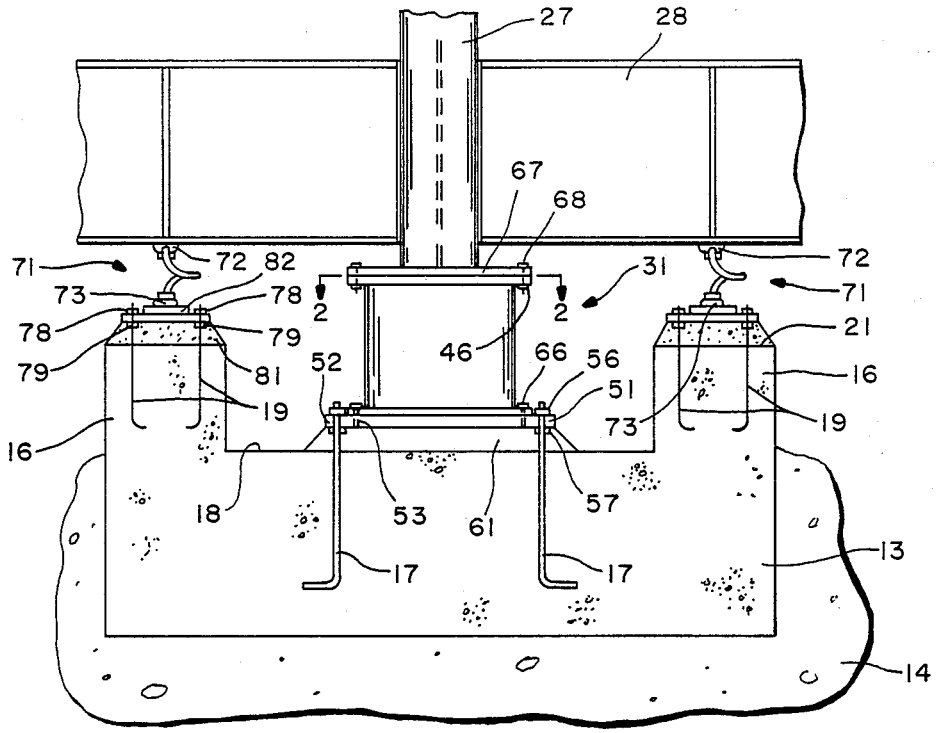
FIG. 1 is a cross sectional view of a building support which includes a seismic isolation structure.

In general it is an object of the present invention to provide a seismic isolation structure for use in conjunction with a foundation comprised of a plurality of footings and a building having a plurality of support columns adapted to be supported by the footings of the foundation. At least one high damping elastomeric bearing is adapted to be connected between the footing and the column and at least one ultimate restraint device connected between the footing and the support column. The ultimate restraint device is spaced from and is separate from the bearing.

More particularly as shown in the drawing, the seismic support structure 11 is adapted to be used in conjunction with a foundation of a building in which the foundation is provided with a plurality of spaced apart footings 13 that are positioned in the soil 14. The footings 13 are formed in a conventional manner by the use of steel reinforcing (not shown) and concrete. Each of the footings is providing with a pair of upstanding spaced apart pedestals 16. Anchor bolts 17 are provided in the footings at the time the footings are poured and extend upwardly above a surface 18. Additional anchor bolts 19 are provided in the pedestals 16 and extend upwardly through surfaces 21.

The building 26 comprises a plurality of support columns 27. The support columns 27 can be of any conventional type as, for example, reinforced concrete columns or, alternatively, as shown in the drawings, structural steel support columns 27 which are tied together by tie beams 28. The tie beams 28 are connected to the support columns in a suitable manner such as by welding.

Figure 2:
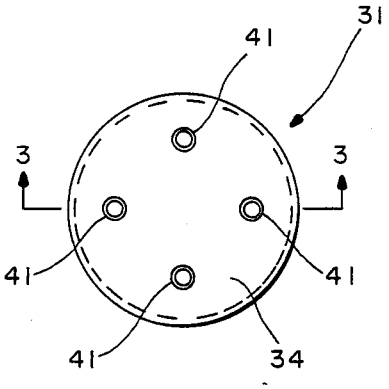
FIG. 2 is a top plan view of the high damping elastomeric bearing shown in FIG. 1.
Figure 3:
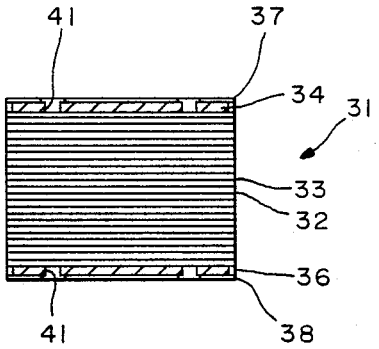
FIG. 3 is a cross sectional view taken along the line 3—3 of FIG. 2.

High damping elastomeric bearings 31 are provided for supporting the support columns 27 on the footings 13. The elastomeric bearings are shown in FIGS. 2 and 3. As shown therein, the bearings consist of spaced apart steel shim plates 32 of a suitable thickness, as for example, 10 to 12 gauge which have their surfaces sandblasted and primed to enhance the vulcanization of the rubber layers 33 which are juxtaposed between the plates 32. By way of example, the shim plates 32 can have a thickness of 0.0146 inches with a diameter of approximately 19 inches, whereas the rubber layers 33 can have a suitable thickness as, for example, 0.4899 inches.

The solid elastic material which is utilized for the layers 33 is mixed with additives which provides elastomer ozone resistance, bond strength, tensile strength, stiffness and the desired damping qualities. The damping provided by the elastomer is important in that it transforms earthquake energy into heat by reducing the oscillation effects of the system.

The bearings 31 also include top and bottom steel plates 34 and 36. The plates 34 and 36 can have a suitable diameter, as for example, 20 inches and can have a thickness of approximately one inch. The exposed surfaces of the top and bottom plates 34 and 36 are provided with rubber covers 37 and 38 of a suitable thickness as, for example, 3/16". Cylindrical holes 41 are provided in the top and bottom plates 34 and 36 and approximately 90° apart and are spaced approximately six inches off center. The entire assembly which is shown in FIG. 3 is subjected to heat and pressure to vulcanize the rubber and to form a composite bearing 31 which serves as a high damping seismic isolator.

Figure 4:
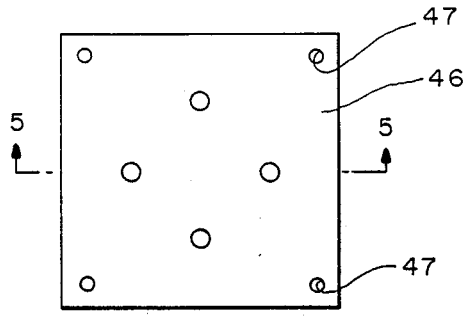
FIG. 4 is a top plan view of the end plate utilized in the isolation structure shown in FIG. 1.
Figure 5:
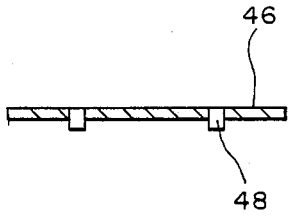
FIG. 5 is a cross sectional view taken along the line 5—5 of FIG. 4.

Installation of the bearings 31 is accomplished by providing a rectangular end plate 46 of suitable dimensions as, for example, 24 inches by 24 inches with a thickness of one inch as shown in FIG. 4. The end plate 46 is provided with four holes 47, one being provided in each corner of the plate. The end plate is also provided with a plurality of dowels 48. Thus, as shown, there are provided four of such dowels 48 which are mounted on the end plate 46 in a suitable manner such as welding. The dowels can extend above the surface of the end plate by suitable distance, as for example, 15/16". The dowels are spaced 90° apart and are spaced six inches from center, as are the holes 41 provided in the top and bottom plates 34 and 36.

A base plate 51 is provided for each of the bearings 31 and has a size which is slightly larger than the end plate 46. For example, the base plate can have a suitable dimension such as 28 inches by 28 inches with a thickness of 1½". The base plate 51 is provided with holes 52 in the corners of the same which are adapted to receive the anchor members 17 extending up through the surface 18. The base plate 51 is also provided with four tapped holes 53 which are spaced inwardly from the holes 52 and which are adapted to line up with the holes 47 provided in the end plate 46. The base plate 51 is leveled on the anchor members 17 by the use of leveling nuts 56 and 57. After the base plate has been leveled, a dry pack grout 61 of a non-shrink type is placed below the base plate 51 to provide a support for the base plate.

After the grout 61 has set, an end plate 46 can be mounted on the plate by the use of screws 66 extending through the holes 47 and being threaded into the tapped holes 53 provided in the base plate to secure the end plate to the base plate. Thereafter the bearing 31 can be positioned on the upstanding dowels 48 so that the dowels 48 extend downwardly into the holes 41. An end plate 46 can then be mounted on the top side of the bearing 31 so that the dowels 48 extend into the holes 41 provided in the top end plate 34. The top end plate can then be secured to a base plate 67 welded to the bottom of the support column 27 by the use of bolts 68.

Figure 6:
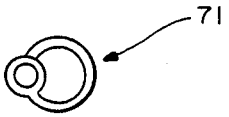
FIG. 6 is a plan view of the ultimate restraint device utilized in the seismic isolation structure shown in FIG. 1.
Figure 7:
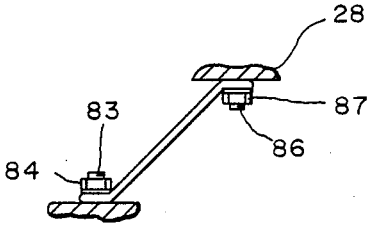
FIG. 7 is a cross-sectional view showing the position at ultimate displacement of the ultimate restraint device.

The seismic support structure 11 also includes ultimate restraint devices 71. The restraint devices 71 are formed of a suitable material such as a mild A36 steel rod having a tensile strength of approximately 70 kips per square inch. The device 71 is provided with circular eyelets 72 and 73 at opposite ends. The restraining device is also provided with a curled elongate element 74 extending between the eyelets 72 and 73 and formed integral therewith. The element 74 has a normally curled position. The curled element 74 has a three-dimensional configuration as shown in FIGS. 1 and 6 and extends through approximately 360°. The eyelets 72 and 73 can be formed by bending the rod into a circle and welding the end of the rod to an adjacent portion of the rod at the weld line 75 as shown in FIG. 6. The device is shaped in this manner so that it provides very little restraint in a horizontal direction until it reaches an ultimate displacement as shown in FIG. 7 at which time its full capabilities are applied to prevent further displacement. The exact dimensions of the curled element are determined by the displacement which it is desired to permit. Typically, a building is designed for the ultimate displacement caused by a five hundred year return earthquake plus another 50% safety factor provided by the code of the Structural Engineers Association of California. Thus, for example, if the five hundred year design for a building prescribes a displacement of 10 inches, the code would provide another 50% safety factor to permit an ultimate displacement of 15 inches. Thus, the length of the element 74 would be selected to have a length of 15 inches, in addition to the vertical distance between the eyelets 72 and 73.

Each of the ultimate restraint devices 71 can be mounted in a suitable manner. Thus there has been provided a plate 76 which can be rectangular in form and which is provided with four holes 77, one on each of the four corners, which are adapted to receive the anchor bolts 19 embedded in the footing 13. The plate 76 can be leveled by the use of leveling nuts 78 and 79. A dry pack grout 81 of the non-shrink type can be placed below the plate to support the same. Thereafter, another plate 82 can be provided which can be field welded to the plate 76. The plate 82 is provided with a threaded stud 83 over which an eyelet 73 can be positioned and fastened by the use of a nut 84 with a tension indicating washer 85. In a similar manner, a threaded stud 86 can be provided on the tie beam 28 with the eyelet 72 and mounted thereon and and retained by a nut 87 and with a tension indicating washer 88.

Thus it can be seen that with the arrangement shown in FIG. 1, there is provided an ultimate restraint device 71 which is spaced apart and separate from the bearing 31 which is provided for each of the footings for supporting the columns 27 of the building.

The ultimate restraint devices 71 provide fail-safe features for the seismic support structure. In the improbable event of an earthquake occurring which is larger than that designed for, the load carrying bearings 31 would be shifted to a displacement beyond their design displacements with a factor of safety which is prevented by the ultimate restraint devices 71 that serve to prevent failure of the bearings in the event of such an earthquake.

At small displacements, as for example, as a result of wind loading on the building, the ultimate restraint devices provide additional horizontal stiffness in the seismic support structure. Thus prior to reaching the ultimate displacement position shown in FIG. 7, the device acts as a hysteretic damper increasing damping in the isolation system. This damping is achieved through the distortion of the steel rods forming the ultimate restraint devices during an earthquake. It has been found that additional equivalent viscous damping of 10% or more can be achieved through the proper design of these ultimate restraint rod-like devices. When the ultimate displacement is reached the ultimate restraint devices 71, having been straightened or uncurled as shown in FIG. 7, provide an ultimate resistance equivalent to the ultimate tensile capacities of the devices.

Figure 8:
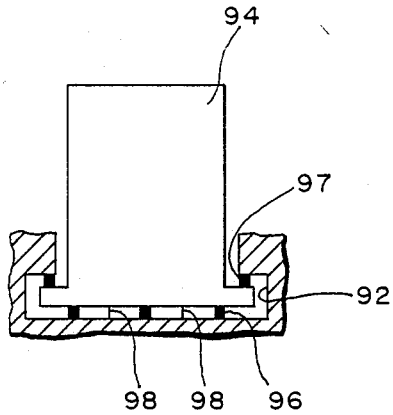
FIG. 8 is a cross sectional view of another embodiment of the invention showing the manner in which the seismic isolation structure would be utilized to prevent overturning.
Figure 9:
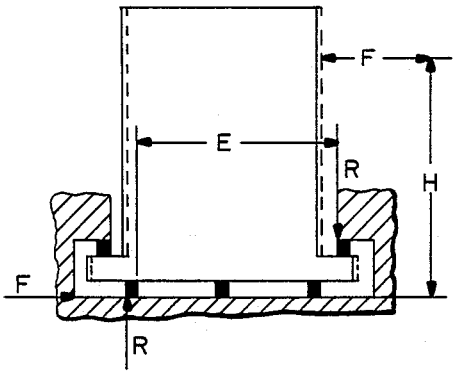
FIG. 9 is a schematic diagram showing the overturning moment and the resisting moment of the structure shown in FIG. 8.

In the event it is desired to utilize the seismic support structure of the present invention in connection with very tall buildings where an overturning element may be encountered, a design such as shown in FIG. 8 can be utilized. As shown therein, the footing 91 is specially configured to provide a T-shaped recess 92 which is adapted to receive a flange 93 provided on the column 94 of the building. Bearings 96 of the type hereinbefore described underlie the flange 93. Additional bearings 97 which are adapted to overlie the flange 96 provide uplift control. Ultimate restraint devices 98 of the type hereinbefore described also can be provided which are spaced apart from the bearings 96. FIG. 9 shows the manner in which the bearings 97 operate to provide uplift control. The overturning moment is determined by $F \times H$ whereas the resisting moment is determined by $R \times E$.

It can be seen from the foregoing that there has been provided a seismic support structure which can be readily incorporated in buildings of various types to provide earthquake protection and also in conjunction with very tall buildings to provide uplift control along with earthquake protection.

What is claimed is:

1. In a seismic isolation structure for use in conjunction with a foundation of a building having a plurality of footings and a plurality of columns and a plurality of beams, at least one high damping elastomeric bearing adapted to be mounted on one of said footings on the building and suporting one of said columns of the building and at least one ultimate restraint device adapted to be connected between one of said footings and one of said beams said ultimate restraint device being spaced apart and separate from the elastomeric bearing, said ultimate restraint device having a normally curled position and in the normally curled position providing a relatively low horizontal stiffness, said ultimate restraint device being movable to an uncurled position without exceeding the design displacement of said bearing to provide an ultimate restraint for movement in a horizontal direction.

2. A structure as in claim 1 wherein said bearing is comprised of superposed layers of elastomeric material and metal top and bottom plates.

3. A structure as in claim 2 together with metal end plates removably secured to the top and bottom plates, cooperative means carried between the top and bottom plates and the end plates to eliminate horizontal movement between the same and means for securing the end plates to the footing and to the support column.

4. A structure as in claim 3 in which the cooperative means is in the form of holes in one of the plates and dowels carried by the other of the plates.

5. In a building structure having seismic isolation a plurality of footings, a plurality of beams, a plurality of high damping elastomeric bearings mounted on said footings and supporting said columns and a plurality of ultimate restraint devices connected between said footings and said beams, said ultimate restraint devices being spaced apart and separate from the elastomeric bearing, said ultimate restraint devices each having a normally curled position and in the normally curled position providing a relatively low horizontal stiffness, said ultimate restraint devices also each being movable to an uncurled position without exceeding the design displacement of said bearing to provide an ultimate restraint for movement of the building in a horizontal direction with respect to the footings.

* * * * *